US005683278A

United States Patent [19]

Pietsch et al.

[11] Patent Number: 5,683,278

[45] Date of Patent: Nov. 4, 1997

[54] STERN TUBE SEAL WITH A PRESSURE CONTROL SYSTEM TO ADJUST TO THE CHANGING DRAFT OF OCEAN-GOING SHIPS

[75] Inventors: Günter Pietsch; Holger Hillig, both of Hamburg; Bodo Voss, Buxtehude; Ernst-Peter Von Bergen, Ahlefeld, all of Germany

[73] Assignee: Blohm Voss Holding AG, Hamburg, Germany

[21] Appl. No.: 533,145

[22] Filed: Sep. 25, 1995

[30] Foreign Application Priority Data

Sep. 24, 1994 [DE] Germany ..... 44 34 261.6

[51] Int. Cl.[6] ..... B63H 23/36

[52] U.S. Cl. ..... 440/112; 440/83; 277/3; 277/59

[58] Field of Search ..... 440/83, 112, 111; 277/3, 27, 28, 58, 59, 152; 184/6

[56] References Cited

U.S. PATENT DOCUMENTS 4,984,811 1/1991 Kuwabara et al. ..... 440/83

FOREIGN PATENT DOCUMENTS 3742079 6/1989 Germany .

1189739 11/1985 U.S.S.R. ..... 440/83

1404413 6/1988 U.S.S.R. ..... 440/83

*Primary Examiner*—Edwin L. Swinehart

*Attorney, Agent, or Firm*—Nils H. Ljungman and Associates

[57] ABSTRACT

A system to adjust to the changing draft of ocean-going ships on the aft seal system equipped with several outwardly-directed gaskets and one inwardly-directed gasket, in which, between each two outwardly-directed gaskets a ring-shaped chamber is reserved, to which a feed line for compressed air is connected. Integrated into the feed line is a pressure control mechanism and a discharge channel which can periodically empty into the interior of the ship (bilge), whereby the pressure in the ring-shaped chamber is always maintained slightly below the outside water pressure. The system is characterized by the fact that an electronic draft measurement system is located on the ship's hull to supply electric signals which correspond to the current draft, which signals actuate the pressure control mechanism. In addition, for the lubrication system, there are two pressure control mechanisms pressurized by compressed air, and which are also actuated by the signals of the draft measurement system, whereby these pressure control mechanisms are each connected to the gas cushion of their own externally airtight containers which are pressurized with lubricant and in which a specified level is maintained, whereby the one container empties into a ring-shaped chamber between the inwardly-directed gasket and the outwardly-directed gasket, and the other container empties into the lubricant chamber.

20 Claims, 6 Drawing Sheets

STERN TUBE SEAL WITH A PRESSURE CONTROL SYSTEM TO ADJUST TO THE CHANGING DRAFT OF OCEAN-GOING SHIPS

BACKGROUND OF THE INVENTION

1. Field of the Invention

The present invention generally relates to a system to adjust to the changing draft of ocean-going ships on the aft seal system of the ships propeller shaft. The seal system can be equipped with a multiple seal against the outside water and against a lubricant chamber, which multiple seal is equipped on the outside water side with at least one outwardly-directed gasket and on the lubricant side with at least one inwardly directed gasket. A ring-shaped chamber is reserved between each two neighboring gaskets, at least one of which ring-shaped chambers is pressurized by means of a feed line with a gaseous pressure medium, preferably compressed air. The pressure of the pressure medium, by means of a pressure control mechanism integrated into the feed line, can preferably be maintained constantly slightly lower than the outside water pressure and the lubricant pressure, and, connected to the pressurized ring-shaped chamber is a discharge channel which empties into the interior the ship (bilge). In the discharge channel there can be a controlled shut-off mechanism preferably a solenoid valve, which periodically opens and closes, and whereby the feed of the lubricant to the lubricant chamber can be provided by at least one deep tank and a lubricant feed line.

2. Background Information

On similar systems, such as that disclosed in German Patent No. 3742079, which is hereby incorporated by reference, the adjustment is made so that the set point of the pressure control mechanism for the gaseous medium or the static level of the deep tank for the lubricant is typically set by hand, after reading a draft measurement scale or similar device.

Apart from the fact that such an adjustment is imprecise and not objective, on larger ocean-going ships where there is a difference of more than 8 m between the two load water lines BWL and LWL, it is typically necessary to use an automatic pressure adjustment system. The terms "BWL " and "LWL " can be considered to be terms of art which would be readily understood by someone of ordinary skill in the art to which the present invention pertains.

OBJECT OF THE INVENTION

The object of the present invention is to overcome the above deficiencies in systems of the type described above.

SUMMARY OF THE INVENTION

The object of the present invention can therefore be accomplished by the use of a preferably electronic draft measurement system located on the ship's hull, preferably aft or astern, which system can supply signals corresponding to the current draft of the ship and which signals are fed to the pressure control mechanism for the pressure medium, such that this pressure control mechanism continuously adjusts the pressure in the ring-shaped chamber as a function of the draft. For the lubricant system, there can be two pressure control mechanisms, which pressure control mechanisms can be pressurized by a gaseous medium, preferably compressed air, to which pressure control mechanisms the signals from the draft measurement system can also be fed. The pressure control mechanisms can each be connected to the gas cushions of respective containers, which containers are integrated into the lubricant feed line and are externally airtight. The containers can be equipped respectively with at least one float switch, which float switch maintains a constant specified level of the lubricant in the container by means of a shut-off mechanism, preferably a solenoid valve, located on the inlet side of the container. The one container can preferably empty into a ring-shaped chamber between the inwardly-directed gasket and the neighboring gasket, and the other container can empty directly into the lubricant chamber.

As a result of the use of the signals from a preferably electronic draft measurement system, not only is the minimum pressure in the ring-shaped chamber maintained with respect to the two media to be sealed, but also the pressure of the lubricant can be adjusted to the current outside water pressure, and, in particular, is adjusted essentially continuously and automatically.

Moreover, when a ring-shaped chamber for the lubricant is present, like the one which is usually present in larger seal systems, a specified, desired pressure ratio can exist on both sides of the inwardly directed gasket at essentially all drafts.

To increase the protection against flooding or unintentional emptying of the tanks or containers, the containers can each have a float switch, for the limitation of the lubricant to a maximum level, and each container can have an additional float switch for the limitation of the lubricant to a minimum level. In addition, each container can be equipped with a shut-off mechanism, so that, when necessary, they can be emptied into the interior of the ship (bilge).

To essentially guarantee that when an obstruction is formed in the discharge channel as the result of a dirt plug or similar phenomenon, with the consequent flooding of the ring chamber and the feed line for the compressed air, the pressure control mechanism and the upstream mechanisms are protected against flooding, the present invention discloses a safety device incorporated into the feed line to the ring-shaped chamber for the gaseous medium. The safety device can have a shut-off mechanism, preferably a solenoid valve, located downstream of the pressure control mechanism, and an externally airtight container located down stream of the solenoid valve. The container can be equipped with a float switch which actuates the shut-off mechanism such that it closes when the float switch is actuated by any backflowing fluid which collects in the container.

A single pressure source is sufficient for the entire system, and the safety of the system is increased by connecting all of the pressure control mechanisms to a common line which leads to the single pressure source. In addition, there can be a condensate trap and a pressure relief valve in the common line.

In addition, there can be a shut-off mechanism which periodically opens and closes the discharge channel automatically, which shut-off mechanism is controlled by automatic switching control equipment so that during normal operation, the interval between actuations is approximately 30 minutes. Further, the length of time the mechanism is open is approximately ⅛ of that interval. During abnormal operation, i.e. when the discharge channel is clogged, the opening time by means of a pressure switch integrated into the discharge channel is approximately three to four times that amount, and, if necessary, the interval between actuations can preferably be reduced by approximately ½, or until the obstruction has been blown out of the discharge channel. With the measures disclosed above, it can become possible to remove obstructions in the discharge passage of the seal system which cannot be removed by normal blowing.

Finally, there can be a control cabinet in which all the electrical and pneumatic lines of the system are combined, whereby the control cabinet has a switching and control panel, in which the displays and alarm mechanisms required for the operation and monitoring of the system are brought together.

The above discussed embodiments of the present invention will be described further hereinbelow with reference to the accompanying figures. When the word "invention " is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

Embodiments of the present invention are illustrated in the accompanying drawings, in which.

DESCRIPTION OF THE PREFERRED EMBODIMENT

Figure 1:
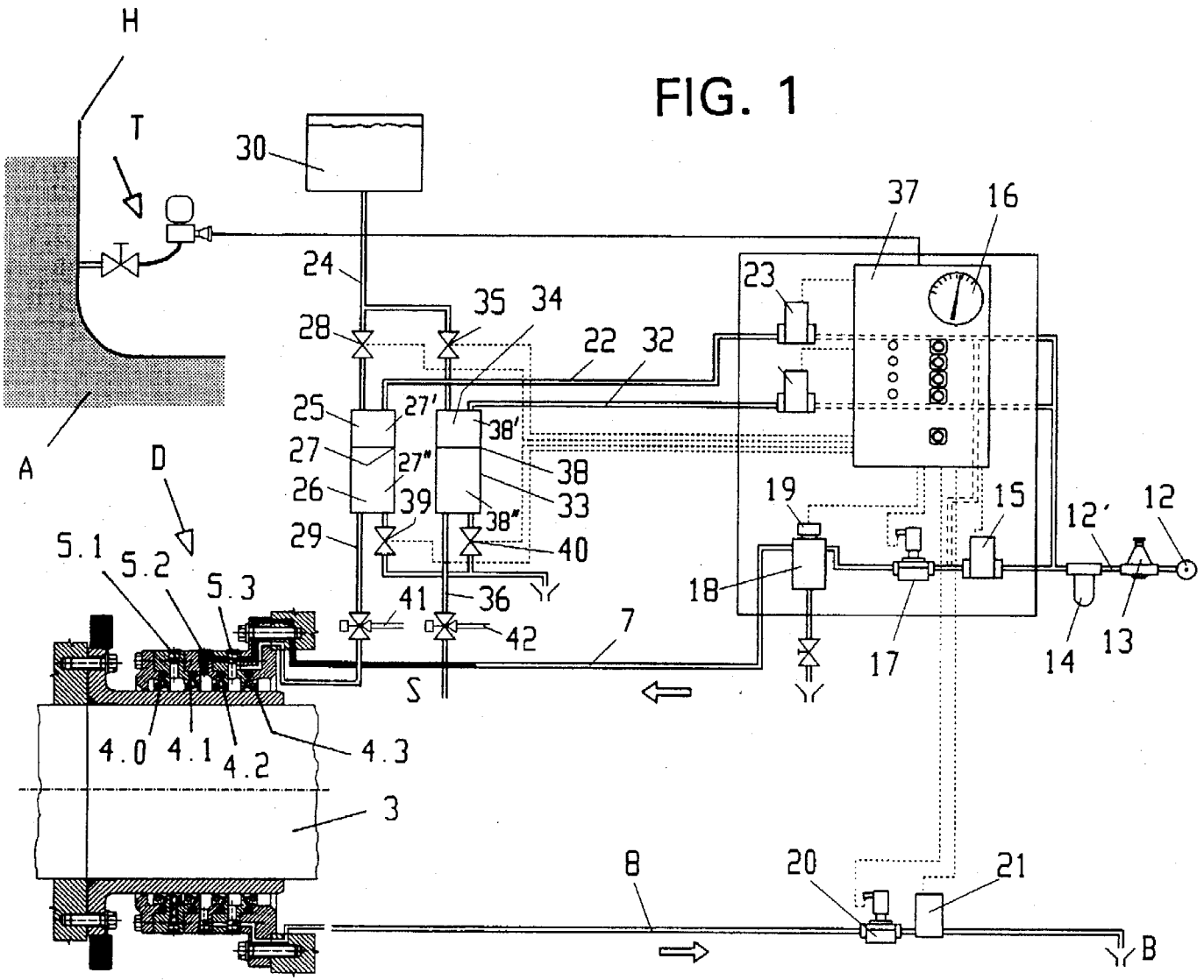
FIG. 1 shows a longitudinal section of an aft seal system for a ships screw propeller with the system in accordance with the present invention to adjust to the changing draft, plus the corresponding control systems and a switching and control panel.
Figure 1A:
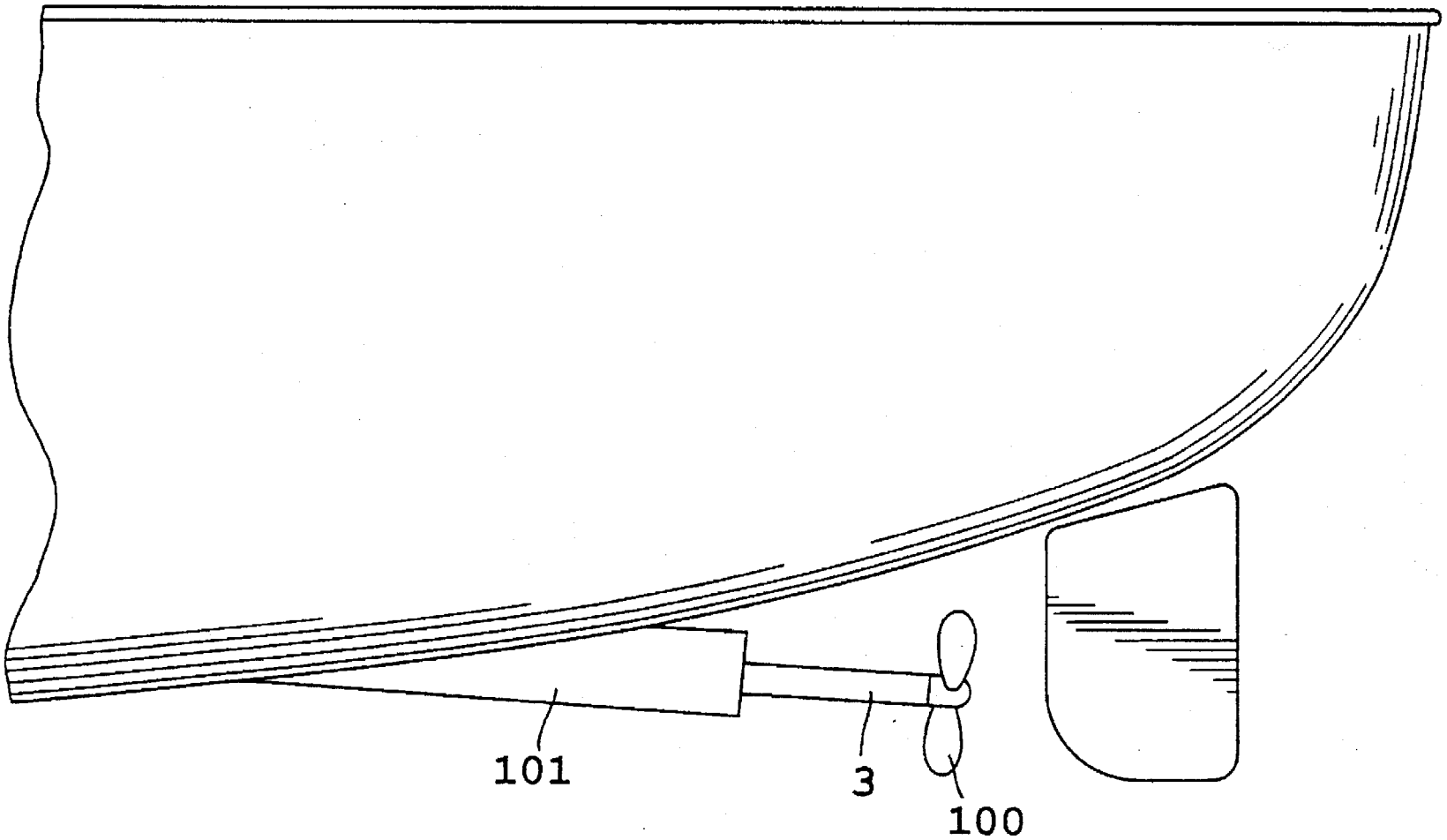
FIG. 1*a* shows an external view of a portion of a deep-draft or seagoing vessel.

FIG. 1*a* generally shows the bottom rear portion of a hull of a typical deep-draft or seagoing vessel with a single propeller 100. A propeller shaft 3 passes from the interior of the ship to the exterior thereof through a stern tube 101. The propeller 100 can preferably be affixed to the end of the shaft 3.

Figure 2:
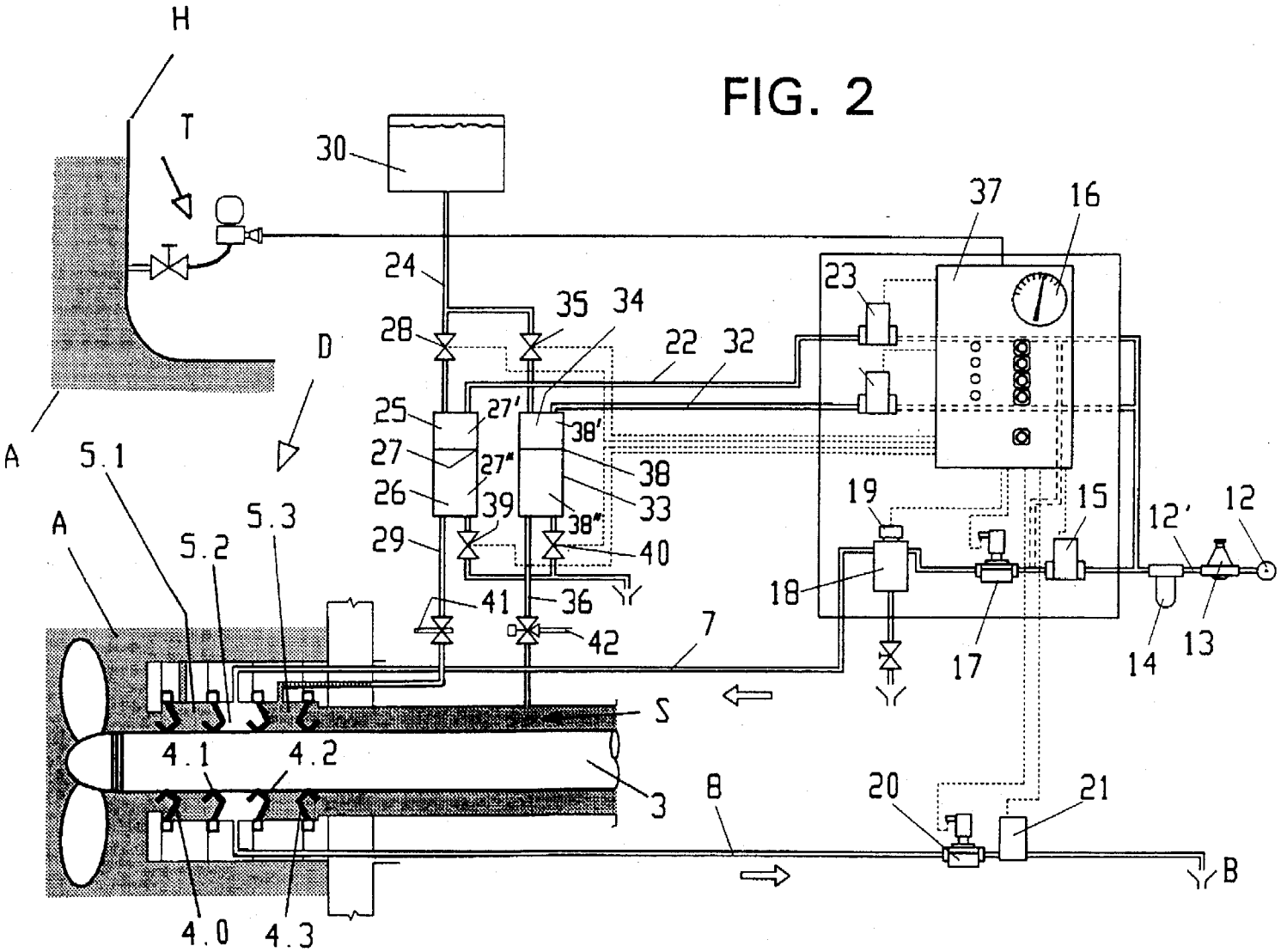
FIG. 2 is essentially the same as FIG. 1, but shows a propeller connected to the propeller shaft of FIG. 1.

Turning now to FIGS. 1 and 2, the seal system D can be equipped with four gaskets 4.0 –4.3, in this case lip seals, which interact with the ships propeller shaft 3, and each of which can be clamped between two stationary housing rings. Three of the gaskets are preferably directed toward the outside water A, and one of the gaskets is preferably directed toward a lubricant chamber S, whereby a ring-shaped chamber 5.1–5.3 is reserved between each two gaskets.

In accordance with one embodiment of the present invention, there can preferably be an additional ring-shaped chamber not specifically labeled here, which additional chamber can be located adjacent gasket 4.0. Such an additional chamber can be seen more clearly in FIGS. 3 and 4 discussed further below, which additional chamber is labeled 5.0' in FIGS. 3 and 4.

The ring-shaped chamber 5.2 which lies between the forwardmost-outside-water-side gasket 4.2 and the neighboring outside-water-side gasket 4.1 is provided with a feed line 7 for a gaseous medium, in this case compressed air, and with a discharge channel 8. The feed line 7 preferably originates from a pressure source 12 and contains, located one after another in the direction of the seal system, a pressure relief valve 13, a condensate trap 14, a pressure control mechanism 15 for the compressed air, a manometer or pressure gauge 16, a solenoid valve 17 and an airtight container or tank 18 with a float switch 19. The last three units can preferably be part of a safety device which prevents the flooding of the pressure control mechanism 15, which is described below in greater detail.

The discharge channel 8 can empty into the inside of the ship (B) and contains a solenoid valve 20, which solenoid valve 20 can be controlled so that it periodically opens and closes the discharge channel 8, so that any fluid which may have seeped into the ring-shaped chamber 5.2 and from there into the discharge channel 8 can be blown into the interior B of the ship. The pressure control mechanism 15 for the compressed air can preferably operate so that it maintains a pressure of the compressed air in the ring-shaped chamber 5.2 which is preferably always slightly below the pressure of the outside water and of the lubricant, generally by 0.1–0.4 bar, whereby the set point can be determined by means of an electronic draft measurement system T, which is shown separately in the drawing and supplies electrical signals which correspond to the current draft H of the ship.

This constant maintenance of a minimum pressure in the ring-shaped chamber 5.2 at essentially all drafts is generally desirable in order to prevent lubricants from being discharged into the outside water A, which would result in pollution of the ocean water.

To also adjust the lubricant pressure to the current draft, the lubrication system, like the pressure medium system, can preferably be connected to the draft measurement system T. For this purpose, there can be a line 22 which is fed from the pressure source 12, and thus carries a gaseous medium, and in which line 22 there can be a pressure control mechanism 23 which maintains a specified pressure, and is actuated by the signals of the draft measurement system T on the basis of the set point selected. After running through the pressure control mechanism 23, the line 22 preferably empties into the gas cushion 25 of a tank or container 26 which is externally airtight, and which container 26 can be connected on the input side by means of a feed line 24 to a ventilated deep tank 30 for the lubricant, and on the outlet side by means of a discharge line 29 to the ring-shaped chamber 5.3 which is located between the lubricant-side gasket 4.3 and the neighboring gasket 4.2.

To maintain a specified lubricant level in the container 26, the container 26 can be equipped with a float switch 27, which float switch 27 can interact appropriately with a shut-off mechanism 28 which is installed upstream on the inflow side.

In accordance with one embodiment of the present invention, float switch 27 can preferably include a float switch 27' for the limitation of fluid to a maximum level and can also include an additional float switch 27" for the limitation of fluid to a minimum level. In addition, the container 26 can also be equipped with a shut-off mechanism 39 so that, if necessary, it can be emptied into the ship's interior (bilge).

In addition to the lubricant feed device described above, there can preferably be a second lubricant feed device which operates in the same manner as the one described above, and which can be equipped accordingly with a pressure control mechanism 31 in a line 32, which line 32 can be fed by pressure source 12, and an externally airtight container 33 with a gas cushion 34. The container 33 would thus preferably empty not into the ring-shaped chamber 5.3, but into the lubricant chamber S upstream of the seal system by means of a feed line 36. In this embodiment, this second lubricant feed device can be connected by means of a shut-off mechanism 35 to the same deep tank 30 as the first, but it can also be fed from a separate deep tank (not shown).

In accordance with one embodiment of the present invention, to maintain a specified lubricant level in the container 33, the container 33 can preferably have a float switch 38 which interacts with the shut-off mechanism 35 which is installed upstream on the inflow side. Further, float switch 38 can preferably include a float switch 38' for the limitation of fluid to a maximum level, and a float switch 38" for the limitation of fluid to a minimum level. In addition, the container 33 can preferably be equipped with a shut-off mechanism 40 so that, if necessary, it can also be emptied into the ship's interior.

In accordance with one embodiment, all of the pressure mechanisms 15, 23, and 31 can be connected to pressure source 12 by a common line 12'.

In the case in which there is an obstruction or clog in the discharge channel 8, which clog, in spite of the periodic opening and closing of the solenoid valve 20, is not blown out of the channel 8, the above-mentioned safety device can be provided with a measure to prevent flooding of the pressure control mechanism 15. After a certain length of time in operation, on account of the underpressure which exists with respect to the outside water pressure and the lubricant pressure, outside water and possibly also lubricant can seep into the ring-shaped chamber 5.2 and into the feed line 7, whereby this fluid can be collected in the container 18, and can fill the container 18 up. This filling up of the container 18 can then actuate the float switch 19 to thereby close the solenoid valve 17. In accordance with one embodiment, due to the increased pressure in the discharge channel 8, a pressure switch 21 can preferably move from the open position to the closed position, and can thus trip a signal in control panel 37. A control cabinet (not shown) can also be provided with a control panel 37, in which the display and alarm mechanisms necessary for the operation and the monitoring of the system can be installed. An additional example of this type of system is shown and described in detail herebelow with regard to FIGS. 3 and 4.

In the event that the control system of the system is taken out of operation as a result of a power failure or other malfunctions, there can preferably be 2/3-way valves 41, 42 installed in the discharge lines 29 and 36, respectively, which valves 41 and 42 supply the system with lubricant from a conventional deep tank system (not shown), so that the entire system can continue to be operated without restrictions.

FIG. 2 shows essentially the same view as FIG. 1, but shows a propeller connected to one end of propeller shaft 3.

The disclosure now turns to a seal system 1', which seal system 1' which can prevent the flooding of a pressure control mechanism 15', which pressure control mechanism 15' can be considered to be similar to pressure control mechanism 15 of the present invention. It should be understood that the components discussed herebelow with regard to FIGS. 3, 4 and 5 can be considered to be interchangeable with similar components discussed hereabove with regard to FIGS. 1*a*, 1 and 2.

Figure 3:
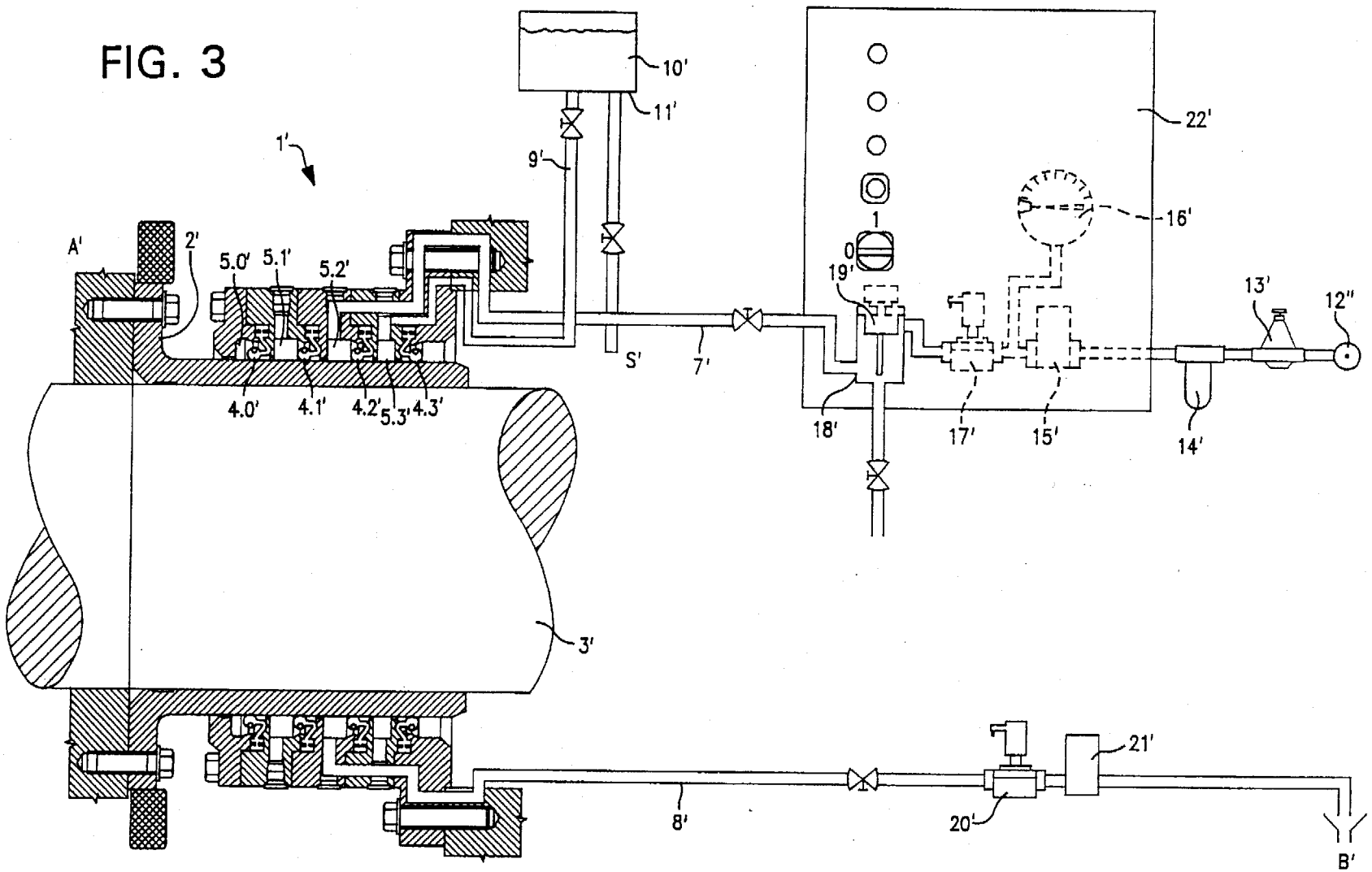
FIG. 3 shows a longitudinal section of an aft seal system for a ship's propeller shaft, as well as the corresponding control system with a safety device, including the switching and control panel.
Figure 4:
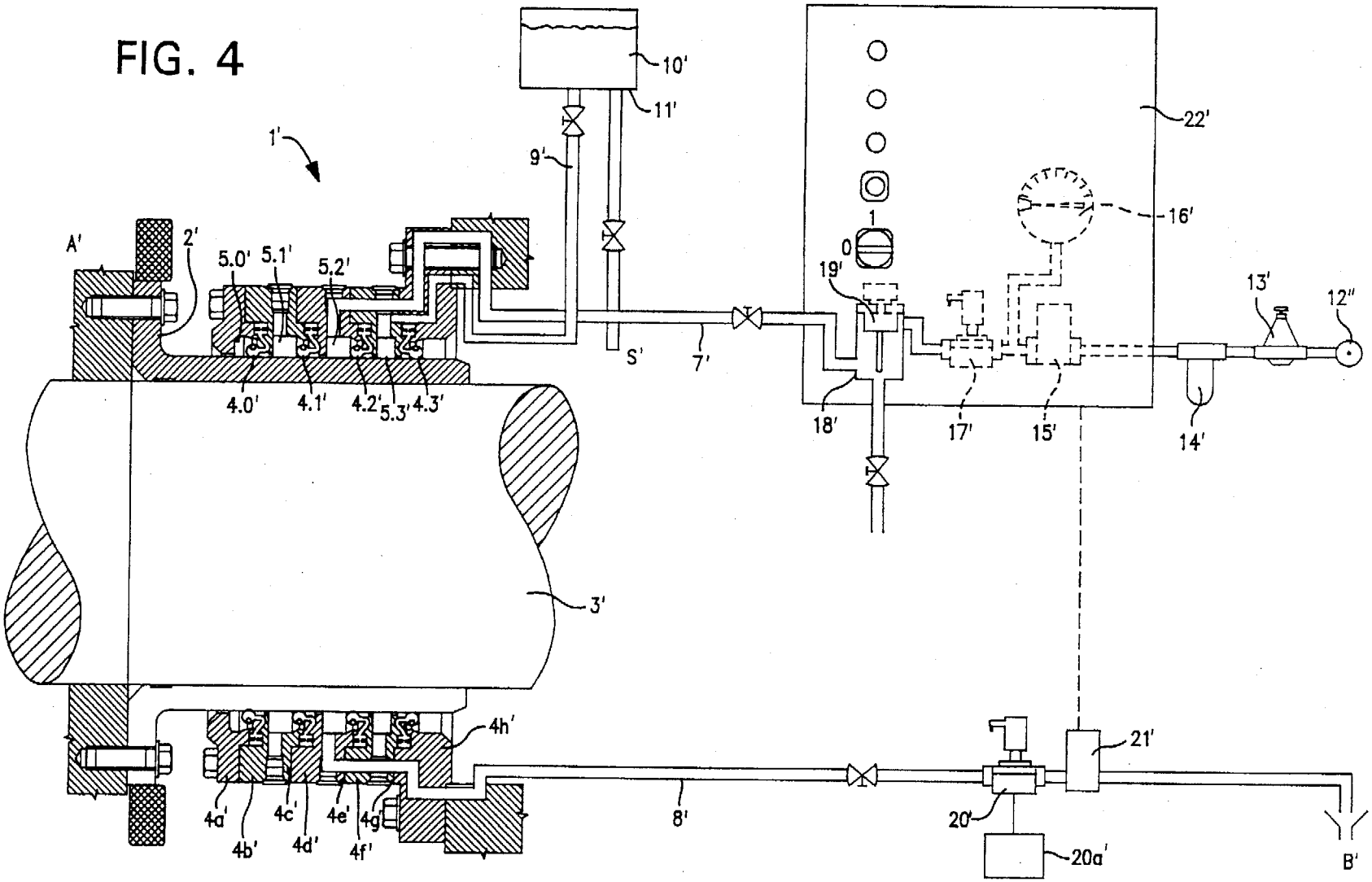
FIG. 4 is essentially the same as FIG. 3, but shows additional components.

Turning now to FIGS. 3 and 4, the seal system 1' can preferably be equipped with four gaskets 4.0'–4.3', which gaskets 4.0'–4.3' interface with a bushing 2' of the ship's propeller shaft 3'. In this case, the four gaskets 4.0'–4.3' can be lip seals, each of which can be clamped between two stationary housing rings. Three of the gaskets can be directed toward the outside water A', while one can be directed toward a lubrication chamber S'. In addition, ring-shaped chambers 5.0'–5.3' can be reserved between each two gaskets. The aftmost gasket 4.0' can be used primarily to keep out dirt, while the neighboring gasket 4.1', together with its ring-shaped chamber 5.1', which chamber 5.1' can be designed as a circulator for outside water, can be used to cool the gaskets.

In accordance with one embodiment of the present invention as shown in FIG. 4, gasket 4.0' can be clamped between a housing ring 4*a'* and a housing ring 4*b'*, gasket 4.1' can be clamped between a housing ring 4*c'* and a housing ring 4*d'*, gasket 4.2' can be clamped between a housing ring 4*e'* and a housing ring 4*f'*, and gasket 4.3' can be clamped between a housing ring 4*g'* and a housing ring 4*h'*.

The ring-shaped chamber 5.2' which lies between the forwardmost gasket 4.2' on the outside water side and the neighboring gasket 4.1' on the outside water side can be provided with a feed line 7' for a gaseous medium, in this case compressed air, and with a discharge channel 8'. The ring-shaped chamber 5.3' which lies between the lubricant-side gasket 4.3' and the adjacent outside water side gasket 4.2' can be equipped with a feed channel 9' for the lubricant 10', which lubricant can be fed by gravity from a ventilated deep tank 11'.

The feed line 7' for the compressed air can preferably originate from a pressure source 12", and in the direction of the sealing system, can contain the following units connected in sequence one after another: a pressure relief valve 13', a condensate trap 14', a pressure relief valve 15', a manometer or possibly a pressure gauge 16', a second solenoid valve 17' and an air-tight container 18' with a float switch 19'.

The discharge channel 8' can empty into the interior of the ship (bilge) B' and contains, located one after the other in the direction of the outlet, a first solenoid valve 20' and a pressure switch 21'. In accordance with one embodiment, the pressure switch 21' can preferably be embodied by a manometric switch, examples of which are given at the close of the instant specification. These units can be designed and electrically connected so that during normal operation, the second solenoid valve 17' can be held open, the first solenoid valve 20' periodically opens and closes the discharge channel 8' automatically, and the pressure switch 21' is in the open position. During abnormal operation, in the event of a blockage in the discharge channel 8' and thus, over time, a flooding of the ring-shaped chamber 5.2', the feed line 7' and the container 18' with fluid, the float switch 19' can close the second solenoid valve 17', whereupon a flooding of the other units of the feed line 7' is prevented, while due to the pressure increase in the discharge channel 8', the pressure switch 21' moves into the closed position and trips a visual electrical signal. In accordance with one embodiment, the pressure switch 21' can preferably trip a visual signal in a control panel 22', discussed further below, for example in the form of a light. Alternatively, the pressure switch 21' could trip an acoustic alarm in control panel 22'.

FIGS. 3 and 4 illustrate a situation in which there is a malfunction caused by a blockage of the discharge channel 8', such as that described briefly above with regard to FIGS. 1 and 2, and a backup of fluid (illustrated as the dark fluid) into the feed line 7' has occurred, whereby the container 18' is filled, i.e. the float switch 19' has already tripped and has closed the second solenoid valve 17'.

If, during normal operation (i.e. loading or unloading of the ship), the outside water pressure should change, the pressure control mechanism 15' is preferably adjusted accordingly (i.e. manually).

There is preferably also a control cabinet (not shown) which has a switching and control panel 22', on which the displays and alarm mechanisms necessary for the operation and monitoring of the system are installed.

In accordance with one embodiment, if necessary, valve 20' can be manually operated by means of a remote manual control switch **20*a*', which control switch 20*a* ' is shown schematically in FIG. 4. Control switch 20*a* could conceivably be incorporated into control panel 22'**, or could be an auxiliary control switch.

Figure 5:
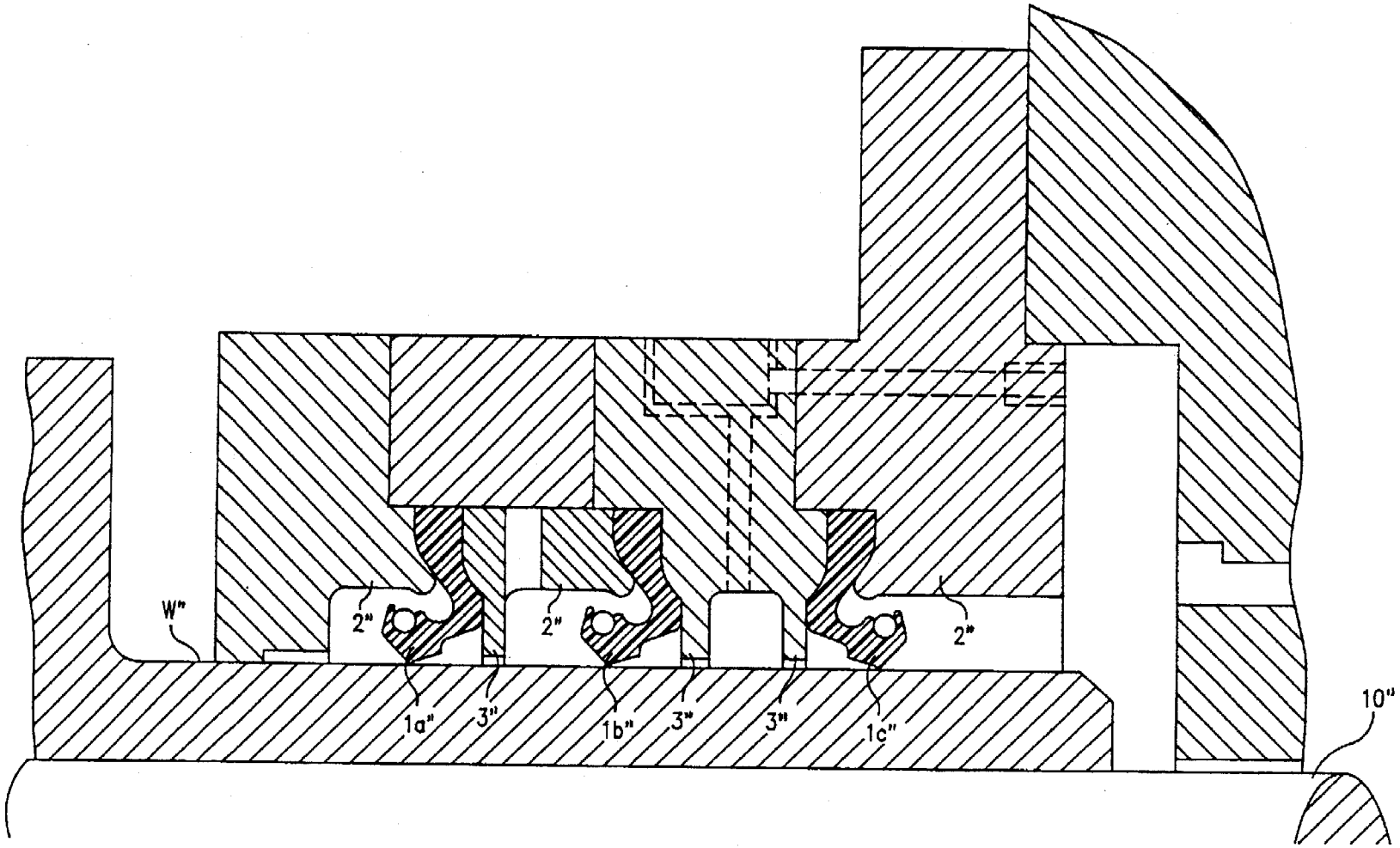
FIG. 5 shows a detailed illustration of a sealing system for a propeller shaft.

FIG. 5 shows a more detailed view of a lip seal arrangement for sealing a propeller shaft which arrangement can be considered to be analogous to the sealing system 1'. Of course, FIG. 5 includes only 3 lip seals **1*a* ", 1*b* ", and 1*c* ", while the system shown in FIGS. 3 and 4 includes 4 such seals 4.0'–4.3'. The sealing arrangement of FIG. 5 is described in detail with relation to FIG. 1*b* of U.S. Pat. No. 5,411,273, which issued to Pietsch et al. on May 2, 1995. This U.S. Patent is hereby incorporated by reference herein. The reference numerals set forth in the aforementioned U.S. Patent, with relation to FIG. 1*b* thereof are each correspondingly represented in FIG. 5** of the instant application by the same reference numerals, but with the addition of a "double-prime " symbol.

One feature of the invention resides broadly in the system to adapt to the changing draft of ocean-going ships on the aft seal system of the ship's propeller shaft, which seal system is equipped with a multiple seal against the outside water and against a lubricant chamber, which multiple seal is equipped on the outside water side with at least one outwardly-directed gasket and on the lubricant side with at least one inwardly directed gasket, whereby a ring-shaped chamber is reserved between each two neighboring gaskets, at least one of which ring-shaped chambers is pressurized by means of a feed line with a gaseous pressure medium, preferably compressed air, whereby also the pressure of the pressure medium, by means of a pressure control mechanism integrated into the feed line, is maintained constantly slightly lower than the outside water pressure and the lubricant pressure, and whereby connected to the pressurized ring-shaped chamber is a discharge channel which empties into the interior of the ship (bilge) and in which there is a controlled shut-off mechanism, preferably a solenoid valve, which periodically opens and closes, and whereby the feed of the lubricant to the lubricant chamber is provided by at least one deep tank and a lubricant feed line, characterized by the fact that a preferably electronic draft measurement system T is located on the ship's hull H, preferably aft or astern, which supplies signals corresponding to the current draft of the ship, which signals are fed to the pressure control mechanism 15 for the pressure medium, such that this pressure control mechanism 15 continuously adjusts the pressure in the ring-shaped chamber 5.2 as a function of the draft, and that for the lubricant system there are two pressure control mechanisms 23, 31 which are pressurized by a gaseous medium, preferably compressed air, to which the signals from the draft measurement system T are also fed, whereby the pressure control mechanisms 23, 31 are each connected to the gas cushions 25, 34 of respective containers 26, 33 which are integrated into the lubricant feed line 24 and are externally airtight, which containers 26, 33 are equipped respectively with at least one float switch 27, 38 which maintains a constant specified level of the lubricant in the container 26, 33 by means of a shut-off mechanism 28, 35, preferably a solenoid valve, located on the inlet side of the container, whereby the one container 26 empties into a ring-shaped chamber 5.3 between the inwardly-directed gasket 4.3 and the neighboring gasket 4.2, and the other container 33 empties directly into the lubricant chamber S.

Another feature of the invention resides broadly in the system characterized by the fact that the containers 26, 33, each with a float switch 27', 38' for the limitation of the lubricant to a maximum level, and each with a float switch 27", 38" for the limitation of the lubricant to a minimum level, are each equipped with a shut-off mechanism 39, 40 so that when necessary, they can be emptied into the interior of the ship (bilge).

Yet another feature of the invention resides broadly in the system characterized by the use of a safety device incorporated into the feed line 7 to the ring-shaped chamber 5.2 for the gaseous medium, equipped with a shut-off mechanism 17, preferably a solenoid valve, located downstream of the pressure control mechanism 15, and an externally airtight container 18 located downstream of the solenoid valve, and equipped with a float switch 17 which actuates the shut-off mechanism 17 such that it closes when the float switch 19 is actuated by any backflowing fluid which collects in the container 18.

Still another feature of the invention resides broadly in the system characterized by the fact that all the pressure control mechanisms 15, 23, 31 are connected to a common line 12', in which there are a condensate trap 14 and a pressure relief valve 13.

A further feature of the invention resides broadly in the system characterized by the fact that the shut-off mechanism 20 which periodically opens and closes the discharge channel 8 automatically is controlled by automatic switching control equipment so that during normal operation, the interval between actuations is approximately 30 minutes, and the length of time the mechanism is open is approximately ⅛ of that interval, and during abnormal operation, i.e. when the discharge channel 8 is clogged, the opening time by means of a pressure switch 21 integrated into the discharge channel 8 is approximately three to four times that amount, and if necessary, the interval between actuations can be reduced by approximately one-half, or until the obstruction has been blown out of the discharge channel 8.

Another feature of the invention resides broadly in the system characterized by the fact that there is a control cabinet in which all the electrical and pneumatic lines of the system are combined, whereby the control cabinet has a switching and control panel 37, in which the display and alarm mechanisms necessary for the operation and monitoring of the system are brought together.

Yet another feature of the invention resides broadly in the safety device for systems to seal a ship's propeller shaft against the outside water and against a lubrication chamber with a multiple seal, which is equipped on the outside water side with at least one gasket directed outward, and on the lubrication chamber side with at least one gasket directed inward, whereby between each two neighboring gaskets a ring-shaped chamber or annulus is reserved, at least one of which is pressurized via a feed line with a gaseous pressure medium, in particular compressed air, whereby the pressure of the pressure medium, by means of a pressure regulation mechanism interposed in the feed line, is constantly kept slightly lower than the pressure of the outside water and the pressure of the lubricant, and whereby connected to the pressurized ring-shaped chamber there is a discharge channel which empties into the interior of the ship (bilge), and in which there is a controlled shut-off mechanism, preferably a solenoid valve, which automatically and periodically opens and closes, and whereby the feed of the lubricant to the lubricant chamber takes place from a deep tank, the static level of which can be adjusted, by means of a lubricant feed line, characterized by the fact that in the feed line 7' to the ring-shaped chamber 5.2' behind the pressure regulation mechanism 15' there is a second shut-off mechanism 17', preferably a solenoid valve, and behind that there is a container 18' which is closed externally airtight with a float switch 19', which actuates the second shut-off mechanism 17', such that when the float switch 19' is tripped by fluid accumulating in the container 18', the second shut-off mechanism 17' closes.

Another feature of the invention resides broadly in the safety device characterized by the fact that a condensate trap 14' and a pressure relief valve 13' are integrated into the feed line 7' between the pressure regulation mechanism 15' and the pressure source 12".

Yet another feature of the invention resides broadly in the safety valve characterized by the fact that if necessary, the first shut-off mechanism 20' can be remotely operated manually.

Still another feature of the invention resides broadly in the safety device characterized by the fact that at some distance from the exit opening into the bilge B', a manometric switch or pressure switch 21' is integrated into the discharge line 8' which is opened at atmospheric air pressure, and in the event of an increase in pressure sends a visual electrical signal to the control cabinet.

A further feature of the invention resides broadly in the safety device characterized by the fact that a feed line 9' empties into the ring-shaped chamber 5.3' between the lubricant-side gasket 4.3' and the neighboring gasket 4.2', which feed line is supplied with the lubricant 10' from the deep tank 11' or from a separate deep tank.

Another feature of the invention resides broadly in the safety device characterized by the fact that there is a control cabinet in which all the electrical and pneumatic lines of the seal system come together, whereby this control cabinet has a switching and control panel 22' on which all of the displays and alarms necessary for the operation and monitoring of the system are installed.

Systems for measuring the draft depth of a ship and pressure control mechanisms which could be utilized in accordance with the present invention are disclosed in the following U.S. Patents: No. 5,186,428 to Falkenberg on Feb. 16, 1993, entitled "Depth Gauge Tranducer Retractor Device"; No. 4,534,217 to Caus on Aug. 13, 1985, entitled "Measuring the Draft of a Vessel"; No. 4,622,912 to Bleke on Nov. 18, 1986, entitled "Draft Reduction System for Ships"; No. 4,495,880 to Maniscalco et al. on Jan. 29, 1985, entitled "Draft Assisted Delivery System"; No. 4,266,500 to Jurca on May 12, 1981, entitled "Hover Control System for a Submersible Buoy"; No. 4,995,014 to Hoornstra on Feb. 19, 1991, entitled "Low Frequency Hydrophone and Depth Sensor Assembly"; and No. 5,235,557 to Masreliez on Aug. 10, 1993, entitled "Combined Speed and Depth Sensor Transducer".

Pressure switches which could be incorporated into the present invention are disclosed in the following U.S. Patents: No. 4,150,268 to Stearley, Rowley, and Buckshaw on Apr. 17, 1979, entitled "Pressure Operated Switch Construction Having a One-piece Control Shaft Bracket Structure"; No. 4,158,117 to Quilliam, Gallantree, and Watt, on Jun. 12, 1979, entitled "Pressure Sensitive Switch"; No. 4,160,139 to Johnston, on Jul. 3, 1979, entitled "Pressure Sensitive Switch"; No. 4,165,650 to Weissler, on Aug. 28, 1979, entitled "Dual Purpose Pressure Sensor"; No. 4,168,415 to Edwards, Penland, Warren, Roberts, on Sep. 18, 1979, entitled "Pressure Switch Having Modular Construction"; and No. 4,182,941 to Tashiro on Jan. 8, 1980, entitled "Improved Pressure Switch".

Relief valves which could be incorporated into the present invention are disclosed in the following U.S. Patents: No. 4,142,549 to Autry on Mar. 6, 1979, entitled "Relief Valve"; No. 4,168,723 to Schneider on Sep. 25, 1979, entitled "Pressure Relief Valve"; No. 4,178,940 to Au on Dec. 18, 1979, entitled "Pressure Control Systems"; and No. 4,185,652 to Zintz, Fisher, and Gee on Jan. 29, 1980 entitled "Subaqueous Sequence Valve Mechanism".

Solenoid valves which could be incorporated into the present invention are disclosed in the following U.S. Patents: No. 4,177,774 to Moshal on Dec. 11, 1979, entitled "Control Valves"; No. 4,180,241 to Fiedler on Dec. 25, 1979, entitled "Solenoid Operated Valve and Shut-Off Device"; and No. 4,195,667 to Moore and Price on Apr. 1, 1980 entitled "Solenoid Valve with Safety Control Circuit".

Manometers which could be incorporated into the present invention are disclosed in the following U.S. Patents: No. 4,154,116, to Stahn and Gygax on May 15, 1979, entitled "Safety Manometer"; No. 4,157,043 to Peterson and Cianci on Jun. 5, 1979, entitled "Maximum Pressure Manometer"; No. 4,217,784 to Neubeck and Julien on Aug. 19, 1980, entitled "Tube Spring Manometer"; No. 4,967,600 to Keller on Nov. 6, 1990 entitled "Manometer"; and No. 4,297,081 to Irvin on Oct. 10, 1981 entitled "Liquid Level Control System".

Examples of control systems for valves which could be incorporated into the present invention are disclosed in the following U.S. Patents: No. 5,218,997 to Dunwoody on Jun. 15, 1993, entitled "Digital Hydraulic Valve Control"; No. 5,280,770 to Satou, Takahashi, and Kitagawa on Jan. 25, 1994, entitled "Variable Valve Actuation Control System"; No. 4,752,258 to Hochleitner and Gross on Jun. 21, 1988 entitled "Device for Controlling a Cycloid Propeller for Watercraft"; and No. 5,318,269 to Oettinger and Latt on Jun. 7, 1994, entitled "Electronic Control System for Magnetic Valves Operated Individually or in Cascade".

Examples of control systems for ships which could be incorporated in the present invention are disclosed in the following U.S. patents: U.S. Pat. No. 4,301,759 to de Vries on Nov. 24, 1981 entitled "Control System, Particularly for Use on Ships"; U.S. Pat. No. 5,222,901 to Burkenpas on Jun. 29, 1993 entitled "Redundant Marine Engine Control System"; U.S. Pat. No. 5,336,120 to Maurer, Braig, Auer, Goebel, Schwarz and Voss on Aug. 9, 1994, entitled "Control System for Operating a Ship's Motive Installation"; U.S. Pat. No. 5,388,542 to Fischer, Drohula and Lüneburg on Feb. 14, 1995 entitled "Water-Borne Ship and Method of Operation Thereof"; U.S. Pat. No. 5,038,269 to Grimble and Fairbairn on Aug. 6, 1991 entitled "Industrial Control Systems"; and U.S. Pat. No. 5,170,338 to Moritoki, Hagiwara, and Katayama on Dec. 8, 1992, entitled "Apparatus for Carrying Out Serial Control and Method of Controlling Said Apparatus".

Lip seal arrangements which could be incorporated into the present invention include the following U.S. patents: U.S. Pat. No. 4,984,811 to Kuwabara and Miyazaki on Jan. 15, 1991 entitled "Pressure Control System for Stern Tube Seals" U.S. Pat. No. 5,411,273 to Pietsch and von Bergen on May 2, 1995, entitled "Lip Seal to Seal a Shaft, In Particular a Ship's Propeller Shaft"; U.S. Pat. No. 5,219,434 to Yon Bergen and Pietsch on Jun. 15, 1993 entitled "Sealing Arrangement for Rotating Propeller Shafts of Ships"; U.S. Pat. No. 5,137,116 to Von Bergen and Pietsch on Aug. 11, 1992 entitled "Sealing Device for a Rotating Shaft of a Ship Propeller Shaft"; U.S. Pat. No. 5,356,320 to Von Bergen and Pietsch on Oct. 18, 1994 entitled "Seal Arrangement for Propeller Shafts of Ships"; and U.S. Pat. No. 4,984,968 to Laverion on Jan. 15, 1991 entitled "Variable Pitch Propellers".

Manometric switches which could be incorporated into the present invention include the following U.S. Patents: No. 5,096,392 to Griebel, Kille, and Kistler on Mar. 17, 1992 entitled "Apparatus for Conveying Paints"; No. 4,740,356 to Huber on Apr. 26, 1988 entitled "Device for Producing a Gaseous Measuring Sample for Atomic Absorption Spectroscopy"; and No. 4,946,316 to Watermann and Schulze-Heiming on Aug. 7, 1990, entitled "Method and Device for Moving a Shield-Type Support Trestle".

Float switches which could be incorporated into the present invention include the following U.S. Patents: No. 4,919,165 to Lloyd on Apr. 24, 1990 entitled "Rainfall Control for Irrigation Systems"; No. 5,017,748 to Sapiro on May 21, 1991 entitled "Float Switch With Buoyant Housing and Switch Operating Means Within the Housing"; No. 5,049,037 to Carson and Bender on Sep. 17, 1991 entitled "Automatic Well Pump Skimmer Level Control"; No. 5,089,676 to Duncan on Feb. 18, 1992 entitled "Liquid Level Float Switch"; No. 5,211,363 to Brown on May 18, 1993 entitled "Bilge Pump Bracket"; and No. 4,742,244 to Koerner on May 3, 1988 entitled "Electronic Float Switch Apparatus".

Some additional examples of shaft seals for sealing about propeller shafts of ships, including typical lip seals as briefly described above, can be found in the following U.S. Patents which have common inventors with the present invention: No. 4,395,141 to Günter Pietsch et al., issued on Jul. 26, 1983 and entitled "Bearing and Seal Assembly for Stern Tubes of Vessels"; No. 4,413,829 to Günter Pietsch, issued on Nov. 11, 1983 and entitled "Shaft Sealing Assembly"; No. 4,413,830 to Günter Pietsch, issued on Nov. 8, 1983 and entitled "Seal Assembly for Rotating Shafts"; No. 4,448,425 to Ernst-Peter Von Bergen, issued on May 15, 1984 and entitled "Shaft Seal Assembly with Inflatable Annular Member"; and No. 5,137,116 to Ernst-Peter Von Bergen and Günter Pietsch, issued on Aug. 11, 1992 and entitled "Sealing Device for Rotating Shaft of a Ship Propeller Shaft".

The components disclosed in the various publications, disclosed or incorporated by reference herein, may be used in the embodiments of the present invention, as well as, equivalents thereof.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The invention as described hereinabove in the context of the preferred embodiments is not to be taken as limited to all of the provided details thereof, since modifications and variations thereof may be made without departing from the spirit and scope of the invention.

What is claimed is:

1. A stern tube seal for a rotating propeller shaft of a ship, the stern tube seal comprising:

a sealing arrangement;

said sealing arrangement being disposed to seal out an outside medium from around the propeller shaft;

said sealing arrangement and the propeller shaft forming a portion of an annular space;

said annular space being disposed about the propeller shaft;

said annular space comprising means for receiving a pressurized fluid for pressurizing said annular space;

a sensor apparatus for sensing the pressure of variable outside water pressure indicating the varying draft of the ship at selected point;

a pressure control mechanism for continuously varying the pressure of the pressurized fluid within said annular space dependent upon the outside water pressure indicating the varying draft of the ship at said selected point;

means for connecting said pressure control mechanism with said annular space;

said pressure control mechanism being connected to said sensor apparatus to receive a signal indicating the varying draft of the ship at said selected point, thus varying the pressure of the pressurized fluid within said annular space dependent upon the signal from said sensor apparatus;

said pressure control mechanism comprising means for increasing and decreasing the pressure of the pressurized fluid within said annular space directly in relation to the pressure of the outside water indicating the varying draft of the ship at said selected point; and said pressure control mechanism being separate from said sealing arrangement.

2. The stern tube seal according to claim 1, further comprising:

means for compressing a fluid to produce the pressurized fluid; and means for supplying the pressurized fluid to said pressure control mechanism.

3. The stern tube seal according to claim 2, further comprising:

said sealing arrangement being a first sealing arrangement;

a second sealing arrangement;

said second sealing arrangement is disposed to seal out a lubricating fluid from said annular space;

said second sealing arrangement and the propeller shaft form a portion of a lubricating space;

said lubricating space is disposed about the propeller shaft;

said lubricating space comprises means for receiving a lubricating fluid to pressurize said lubricating space;

means for varying the pressure of a lubricating fluid within said lubricating space;

said means for varying the pressure of a lubricating fluid within said lubricating space is operatively connected to said means for receiving a lubricating fluid;

said means for varying the pressure of a lubricating fluid within said lubricating space is operatively connected to said sensor apparatus to receive a signal indicating the varying draft of the ship at said selected point;

said means for varying the pressure of a lubricating fluid within said lubricating space comprises means for increasing and decreasing the pressure of lubricating fluid within said lubricating space in response to a signal from said sensor apparatus;

the pressurized fluid being a first pressurized fluid;

means for compressing a fluid to produce a second pressurized fluid; and means for supplying the second pressurized fluid to said means for varying the pressure of a lubricating fluid within said lubricating space to pressurize a lubricating fluid in said lubricating space.

4. The stern tube seal according to claim 3, wherein said means for increasing and decreasing the pressure of a lubricating fluid within said lubricating space comprises:

means for receiving the second pressurized fluid from said means for supplying the second pressurized fluid;

means for adjusting the pressure of the second pressurized fluid in response to a signal from said sensor apparatus;

said means for adjusting the pressure of the second pressurized fluid is operatively connected to said means for receiving the second pressureized fluid;

means for converting a change in pressure of the second pressurized fluid to a change in pressure of a lubricating fluid in said lubricating space; and means for converting a change in pressure of the second pressurized fluid comprises means for receiving the second pressurized fluid from said means for adjusting the pressure of the second pressurized fluid.

5. The stern tube seal according to claim 4, wherein said lubricating space comprises:

a first chamber;

said first chamber being disposed about the propeller shaft;

said first chamber being disposed to lubricate the propeller shaft with a lubricating fluid;

said first chamber is disposed adjacent to said annular space;

a second chamber;

said second chamber being disposed about the propeller shaft;

said second chamber being disposed to lubricate the propeller shaft with a lubricating fluid; and said second chamber is disposed adjacent to said first chamber.

6. The stern tube seal according to claim 5, wherein:

said pressure control mechanism being a first pressure control mechanism; and said means for adjusting the pressure of the second pressurized fluid comprises:

a second mechanism for controlling pressure;

said second pressure control mechanism is operatively connected to said sensor apparatus to receive a signal indicating the varying draft of the ship at said selected point;

said second pressure control mechanism comprises means for increasing and decreasing the pressure of the second pressurized fluid directly in relation to a signal from said sensor apparatus;

a third mechanism for controlling pressure;

said third pressure control mechanism is operatively connected to said sensor apparatus to receive a signal indicating the varying draft of the ship at said selected point; and said third pressure control mechanism comprises means for increasing and decreasing the pressure of the second pressurized fluid directly in relation to a signal from said sensor apparatus.

7. The stern tube seal according to claim 6, wherein said means for converting a change in pressure of the second pressurized fluid comprises:

a first container;

said first container is operatively connected to said second pressure control mechanism to receive the second pressurized fluid from said second pressure control mechanism;

said first container comprises a first pocket of the second pressurized fluid;

said first container being configured for storing a lubricating fluid;

said first pocket of the second pressurized fluid is in contact with the lubricating fluid in said first container;

said first container comprises means for maintaining a substantially constant level of lubricating fluid within said first container;

a second container;

said second container is operatively connected to said third pressure control mechanism to receive the second pressurized fluid from said third pressure control mechanism;

said second container comprises a second pocket of the second pressurized fluid;

said second container being configured for storing a lubricating fluid;

said second pocket of the second pressurized fluid is in contact with the lubricating fluid in said second container; and said second container comprises means for maintaining a substantially constant level of lubricating fluid within said second container.

8. The stern tube seal according to claim 7, wherein said means for converting a change in pressure of the second pressurized fluid further comprises:

a first tank;

said first tank is configured for containing a lubricating fluid;

said first container is operatively connected to said first tank to receive a lubricating fluid from said first tank;

said second container is operatively connected to said first tank to receive a lubricating fluid from said first tank;

means for connecting said first container and said first chamber to permit flow of lubricating fluid between said first container and said first chamber; and means for connecting said second container and said second chamber to permit flow of lubricating fluid between said second container and said second chamber.

9. The stern tube seal according to claim 8 wherein:

said means for maintaining a substantially constant level of lubricating fluid within said first container comprises:

means for sensing a level of lubricating fluid in said first container;

means for controlling the flow of lubricating fluid into said first container from said first tank; and said means for controlling the flow of lubricating fluid into said first container is actuated in response to said means for sensing a level of lubricating fluid in said first container;

said means for maintaining a substantially constant level of lubricating fluid within said second container comprises:

means for sensing a level of lubricating fluid in said second container;

means for controlling the flow of lubricating fluid into said second container from said first tank; and said means for controlling the flow of lubricating fluid into said second container is actuated in response to said means for sensing a level of lubricating fluid in said second container.

10. The stern tube seal according to claim 9, wherein:

said means for sensing a level of lubricating fluid in said first container comprises:

means for sensing a maximum level of lubricating fluid in said first container;

said means for sensing a maximum level of lubricating fluid in said first container comprises a first float switch;

means for sensing a minimum level of lubricating fluid in said first container; and said means for sensing a minimum level of lubricating fluid in said first container comprises a second float switch;

said means for sensing a level of lubricating fluid in said second container comprises:

means for sensing a maximum level of lubricating fluid in said second container;

said means for sensing a maximum level of lubricating fluid in said second container comprises a third float switch;

means for sensing a minimum level of lubricating fluid in said second container; and said means for sensing a minimum level of lubricating fluid in said second container comprises a fourth float switch;

said means for controlling the flow of lubricating fluid into said first container comprises a first solenoid valve; and said means for controlling the flow of lubricating fluid into said second container comprises a second solenoid valve.

11. The stern tube seal according to claim 10, further comprising:

means for emptying the lubricating fluid in said first container into a bilge of the ship; and means for emptying the lubricating fluid in said second container into the bilge of the ship.

12. The stern tube seal according to claim 11, wherein:

said means for compressing a fluid to produce the first pressurized fluid and said means for compressing a fluid to produce the second pressurized fluid together comprise a pressure source;

said means for supplying the first pressurized fluid to said first pressure control mechanism comprises:

a pressure supply line;

said pressure supply line is operatively connected to said pressure source;

said pressure supply line comprises a pressure relief valve;

said pressure supply line comprises a condensate trap;

a first pressure line; and said first pressure line connects said pressure supply line to said first pressure control mechanism;

said means for supplying a second pressurized fluid to said means for varying the pressure of a lubricating fluid within said lubricating space comprises:

said pressure supply line;

a second pressure line;

said second pressure line connects said pressure supply line to said means for receiving the second pressurized fluid from said means for supplying the second pressurized fluid;

a third pressure line; and said third pressure line connects said pressure supply line to said means for receiving the second pressurized fluid from said means for supplying the second pressurized fluid;

said first pressurized fluid being compressed air; and said second pressurized fluid being compressed air.

13. The stern tube seal according to claim 12, further comprising:

means for draining a leakage of at least one of outside water and lubricating fluid from said annular space and into the bilge of the ship; and said means for draining a leakage of at least one of outside water and lubricating fluid from said annular space and into the bilge of the ship comprises:

a channel;

said channel is connected to said annular space;

said channel is connected to the bilge of the ship;

a third solenoid valve disposed in said channel;

said third solenoid valve opens and closes on a first interval to permit drainage of the leakage into the bilge of the ship;

a pressure switch disposed in said channel;

said pressure switch comprises means for detecting a blockage of said channel; and said third solenoid valve opens and closes on a second interval in response to said detecting means of said pressure switch detecting a blockage in said channel.

14. The stern tube seal according to claim 13, further comprising:

means for preventing a build-up of leakage of said at least one of outside water and lubricating fluid from entering said first pressure control mechanism; and said means for preventing a build-up of leakage of said at least one of outside water and lubricating fluid from entering said first pressure control mechanism comprises:

means for storing the build-up of leakage of said at least one of outside water and lubricating fluid;

said means for storing a build-up of leakage of said at least one of outside water and lubricating fluid comprises a second tank;

said second tank is externally airtight;

said second tank comprises means for sensing a predetermined level of allowed build-up in said second tank;

said means for sensing a predetermined level of allowed build-up in said second tank comprises a fifth float switch;

said fifth float switch is actuated in response to a level of build-up of leakage in said second tank reaching the predetermined level of allowed build-up of leakage;

a fourth solenoid valve;

said fourth solenoid valve is operatively connected to said second tank;

said fourth solenoid valve is operatively connected to said first pressure control mechanism; and said fourth solenoid valve being configured for being closed in response to said fifth float switch being actuated by the build-up of leakage into said tank.

15. The stern tube seal according to claim 14 further comprising:

a control cabinet;

said control cabinet comprises a control panel; and said control panel comprises:

means for operating said stern tube seal;

said means for operating said stern tube seal comprises an alarm mechanism;

means for monitoring the status of said stern tube seal; and said means for monitoring the status of said stern tube seal comprises a display mechanism.

16. The stern tube seal according to claim 4, further comprising:

means for preventing a build-up of leakage of said at least one of outside water and lubricating fluid from entering said first pressure control mechanism; and said means for preventing a build-up of leakage of said at least one of outside water and lubricating fluid from entering said first pressure control mechanism comprises:

means for storing the build-up of leakage of said at least one of outside water and lubricating fluid;

said means for storing a build-up of leakage of said at least one of outside water and a lubricating fluid comprises a tank;

said tank is externally airtight;

said tank comprises means for sensing a predetermined level of allowed build-up in said tank;

said means for sensing a predetermined level of allowed build-up in said tank comprises a first float switch;

said first float switch is actuated in response to a level of build-up of leakage in said tank reaching the predetermined level of allowed build-up of leakage;

a first solenoid valve;

said first solenoid valve is operatively connected to said tank;

said first solenoid valve is operatively connected to said first pressure control mechanism and said first solenoid valve is closed in response to said first float switch being actuated by the build-up of leakage into said tank.

17. The stern tube seal according to claim 16, wherein:

said means for compressing a fluid to produce the first pressurized fluid and said means for compressing a fluid to produce a second pressurized fluid together comprise a pressure source;

said means for supplying the first pressurized fluid to said first pressure control mechanism comprises:

a pressure supply line;

said pressure supply line is operatively connected to said pressure source;

said pressure supply line comprises a pressure relief valve;

said pressure supply line comprises a condensate trap;

a first pressure line; and said first pressure line connects said pressure supply line to said first pressure control mechanism;

said means for supplying a second pressurized fluid to said means for varying the pressure of a lubricating fluid within said lubricating space comprises:

said pressure supply line; and means for connecting said pressure supply line to said means for receiving the second pressurized fluid from said means for supplying the second pressurized fluid; said first pressurized fluid being compressed air; and said second pressurized fluid being compressed air.

18. The stern tube seal according to claim 17, further comprising:

means for draining a leakage of at least one of outside water and lubricating fluid from said annular space and into a bilge of the ship; and said means for draining a leakage of at least one of outside water and lubricating fluid from said annular space and into a bilge of the ship comprises:

a channel;

said channel is connected to said annular space;

said channel is connected to the bilge of the ship;

a second solenoid valve disposed in said channel;

said second solenoid valve opens and closes on a first interval to permit drainage of the leakage into the bilge of the ship;

a pressure switch disposed in said channel;

said pressure switch comprises means for detecting a blockage of said channel; and said second solenoid valve opens and closes on a second interval in response to said detecting means of said pressure switch detecting a blockage in said channel.

19. The stern tube seal according to claim 18, wherein:

said pressure control mechanism being a first pressure control mechanism; and said means for adjusting the pressure of the second pressurized fluid comprises:

a second mechanism for controlling pressure;

said second pressure control mechanism is operatively connected to said sensor apparatus to receive a signal indicating the varying draft of the ship at said selected point;

said second pressure control mechanism comprises means for increasing and decreasing the pressure of the second pressurized fluid directly in relation to a signal from said sensor apparatus;

a third mechanism for controlling pressure;

said third pressure control mechanism is operatively connected to said sensor apparatus to receive a signal indicating the varying draft of the ship at said selected point; and said third pressure control mechanism comprises means for increasing and decreasing the pressure of the second pressurized fluid directly in relation to a signal from said sensor apparatus.

20. The stern tube seal according to claim 19 further comprising:

a control cabinet;

said control cabinet comprises a control panel; and said control panel comprises:

means for operating said stern tube seal;

said means for operating said stern tube seal comprises alarm mechanisms;

means for monitoring the status of said stern tube seal; and said means for monitoring the status of said stern tube seal comprises a display mechanism.

* * * * *

UNITED STATES PATENT AND TRADEMARK OFFICE

CERTIFICATE OF CORRECTION

PATENT NO. : 5,683,278

DATED : November 4, 1997

INVENTOR(S) : Günter PIETSCH, Holger HILLIG, Bodo VOSS and Ernst-Peter VON BERGEN It is certified that error appears in the above-identified patent and that said Letters Patent is hereby corrected as shown below:

In column 11, line 14, after 'to', delete "Yon" and insert --Von--.

Signed and Sealed this

Fourth Day of August, 1998

Bruce Lehman

*Attest:*

BRUCE LEHMAN

*Attesting Officer*

*Commissioner of Patents and Trademarks*